US005368179A

United States Patent [19]

Bulle

[11] Patent Number: 5,368,179

[45] Date of Patent: Nov. 29, 1994

[54] CONTAINER HAVING PROPS WHICH CAN BE FOLDED AWAY INTO THE LATERAL STRUCTURAL MEMBERS

[76] Inventor: Jean-Marie Bulle, La Véze, Besancon, France, F-25000

[21] Appl. No.: 969,303

[22] PCT Filed: Jun. 17, 1992

[86] PCT No.: PCT/FR92/00543

§ 371 Date: Apr. 13, 1993

§ 102(e) Date: Apr. 13, 1993

[87] PCT Pub. No.: WO92/22481

PCT Pub. Date: Dec. 23, 1992

[30] Foreign Application Priority Data

Jun. 17, 1991 [FR] France ..... 91 07626

[51] Int. Cl.[5] ..... B65D 90/66

[52] U.S. Cl. ..... 220/1.5; 220/629

[58] Field of Search ..... 220/1.5, 629; 206/599, 206/592

[56] References Cited

U.S. PATENT DOCUMENTS

| | | | |
|---|---|---|---|
| 4,844,672 | 7/1989 | Yuruzvich | 220/1.5 |
| 4,848,018 | 7/1989 | Yuan et al. | 220/1.5 |
| 4,875,814 | 10/1989 | Weller | 220/1.5 |

FOREIGN PATENT DOCUMENTS

| | | |
|---|---|---|
| 443456 | 4/1991 | European Pat. Off. . |
| 1280959 | 11/1961 | France . |
| 1484464 | 5/1967 | France . |

*Primary Examiner*—Joseph Man-Fu Moy
*Attorney, Agent, or Firm*—Weiser & Associates

[57] ABSTRACT

This invention relates to metal containers including two longitudinal lateral members and a plurality of supports articulated on the container body and integral therewith. Each support, in a stored position, can retract into the lateral members of the container such that no part projects from the container.

23 Claims, 2 Drawing Sheets

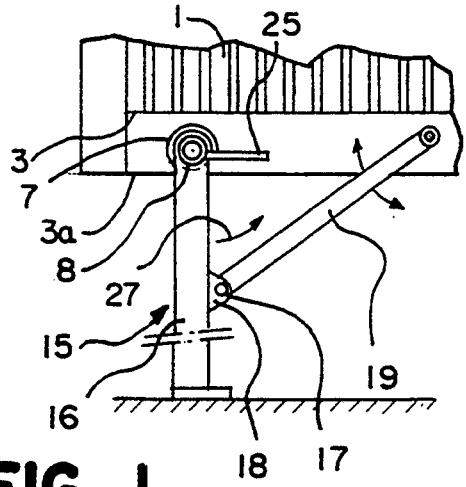
FIG. 1
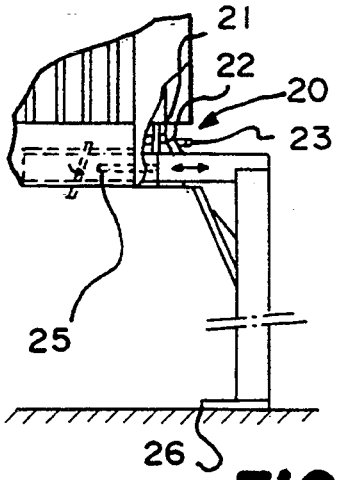
FIG. 2
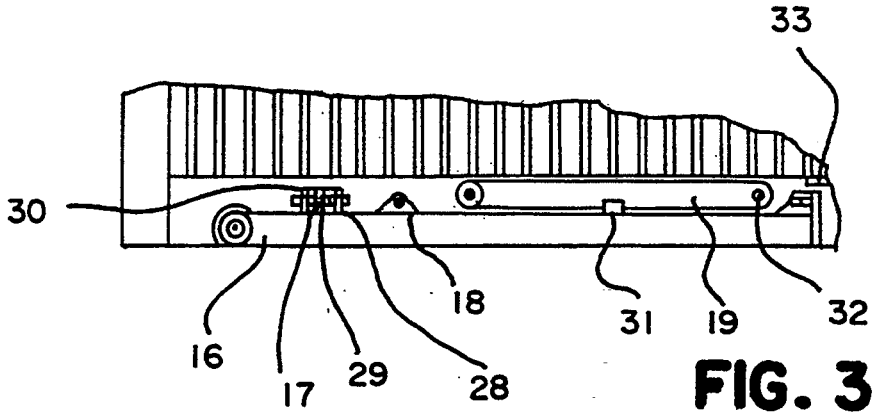
FIG. 3
FIG. 4
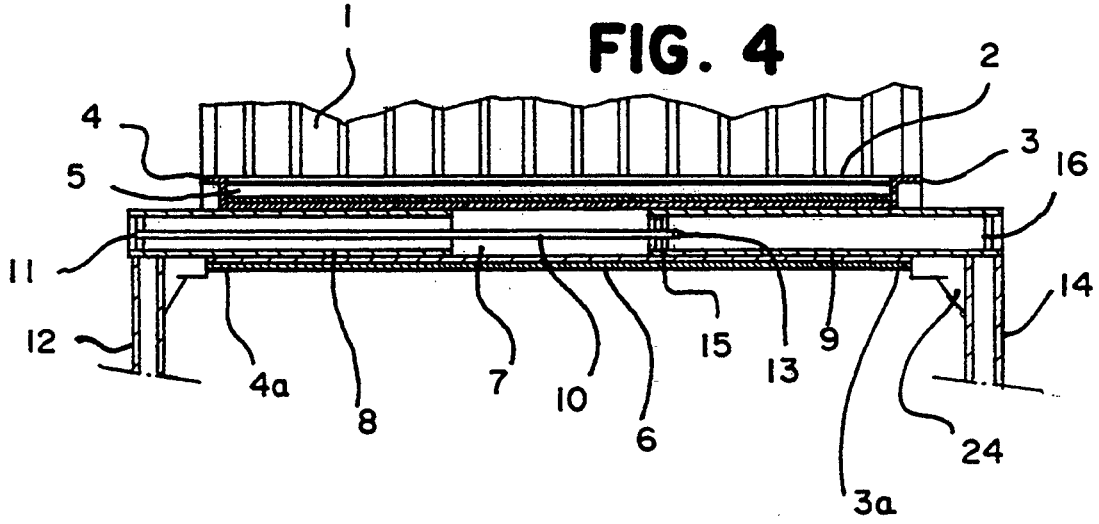

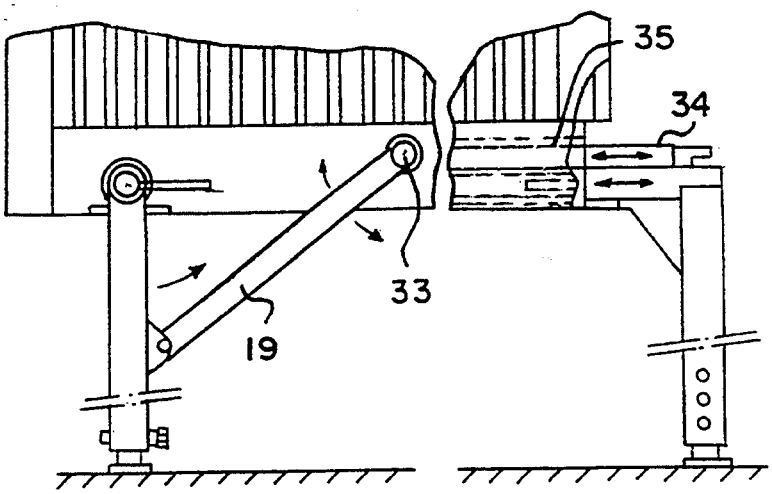
FIG. 5b FIG. 5a
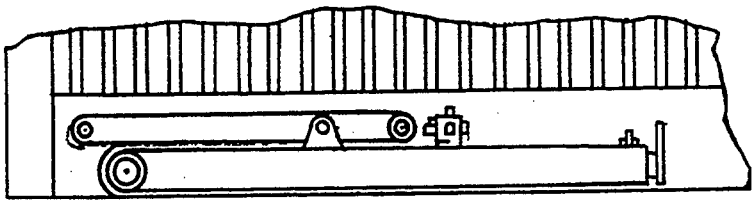
FIG. 5c
FIG. 6
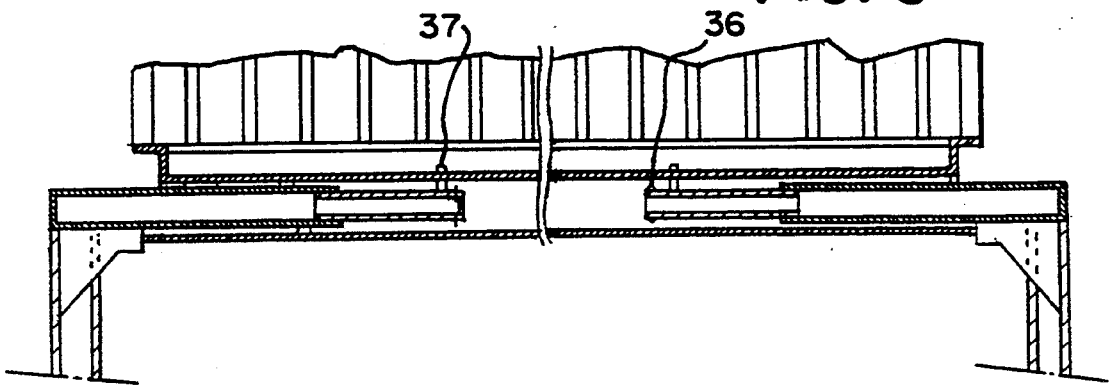

CONTAINER HAVING PROPS WHICH CAN BE FOLDED AWAY INTO THE LATERAL STRUCTURAL MEMBERS

The subject of the present invention is an improvement made to containers, in particular metal containers, of the type comprising two longitudinal lateral structural members as well as a plurality of support props hinged to the body of the container and rigidly attached to it.

Containers of this type are known per se.

However, they exhibit the essential drawback that the props, in the folded-up position, always project with respect to the volume of the container, which is a great drawback for using the latter and handling it.

The object of the invention is to remedy these drawbacks.

In accordance with the invention, for this purpose provision is made for an improvement made to containers, in particular metal containers, of the type comprising two longitudinal lateral structural members as well as a plurality of support props hinged to the body of the container and rigidly attached to it, characterised in that each prop, in the stored position, may be completed folded away into the lateral structural members of the container so as to leave no part projecting beneath the structural volume of the said container.

This device exhibits the advantage of being able to be fitted onto any existing container having lateral structural members, while respecting the constraints connected with the overall size for transporting by road.

The invention will be better understood with the aid of the description given hereinbelow with reference to the attached drawings in which:

FIG. 1 is a partial view, in lateral elevation, of a device in accordance with the invention in an in-use position;

FIG. 2 is a front view of FIG. 1;

FIG. 3 is a partial view, in lateral elevation, of the device of FIG. 1 in a folded-away position;

FIG. 4 is a front view, in cross-section, illustrating a detail of the device for folding away the props;

FIGS. 5*a*, 5*b*, 5*c* and 6 illustrate an alternative embodiment.

According to the essential characteristic of the invention, a device is provided which is rigidly attached to a container able to be incorporated into the volume of the latter and into the original structure of a standard container, for example a 20-foot container constructed according to the ISO standard, the props also remaining rigidly attached to the container in the folded-away position without exceeding the authorised overall size for transporting by road.

Reference will firstly be made to FIG. 4 for understanding the structure of the container.

The latter comprises a so-called container body (1), with a floor (2) and resting on lateral structural members (3, 4) which open outwards laterally and are braced by I-beams (5) rigidly attached to the said structural members.

It will be noted that the structural members extend as far as the base (6) of the container and of its seat, as shown by the sections (3*a*, 4*a*).

According to the invention, a sheath (7) in which the support arms (8, 9) of the props can slide, is arranged from one structural member to the other. While they slide, these support arms are guided and held in the completely opened-out position, so as to prevent them leaving the sheath (7), by a rod (10) fitted at one of its ends with a lockwasher (11) welded to a prop (12) and at its other end with a washer (13) which can slide with respect to the other prop (14). The lockwasher (11) will be welded onto the outer face of the support arm (8). The support arm (9) comprises, at its inner end, a prop-extending lockwasher (15) and, at its outer end, a welded stopper (16).

The ends of each sheath corresponding to a pair of props will be welded onto the structural members (3, 4).

Reference will now be made to FIG. 1, where, for example, the prop (15) has been represented with the corresponding structural member (3, 3*a*) and the container 1.

This figure also shows the cylindrical sheath (7) and the support arm (8).

The prop (15) comprises a bearing arm (16) comprising a removable pin (17) swivelling on a fork joint (18) rigidly attached to the said bearing arm.

A strut (19), hinged to the corresponding structural member at a point (20), the structure of which will be explained hereinbelow, is hinged to this pin (17). The strut can move, just like the bearing arm (16), in a substantially vertical plane.

The removable pin (17) may be fitted with a safety cotter pin.

It will be understood that the assembly can be folded away by withdrawing the pin (17), tilting the strut upwards, tilting the arm (16) upwards and then sliding the latter into the sheath (7).

Reference will now be made to FIG. 2.

The hinge (20) comprises a support plate (21) welded onto the structural member and carrying a pin having a nut (22) with cotter pin.

The strut (19) is hinged to this assembly by means of a ball-and-socket fork joint (23).

In order to strengthen the bearing function of the prop, the latter will comprise, attached to the bearing arm, a substantially triangular gusset-plate (24) (see FIG. 4).

As the prop is stored, the latter will penetrate into an opening (24) of the structural member, seen in FIG. 1 and in dotted lines in FIG. 2.

In the usual manner, each prop will comprise a bearing sole-plate (26) for a better distribution of the force on the ground.

The locking of each prop in the folded-away position in the corresponding structural member will now be explained.

First of all, after disconnecting the strut (19) and the fork joint (18) by removing the pin (17), the bearing arm (16) is tilted upwards in the direction of the arrow (27), whereas the bearing strut is tilted in the same direction.

After the support arm has slid into its sheath, the device occupies the position shown in FIG. 3.

Advantageously, the support arm (16) will comprise an attached part (28) which will interact, for locking, with a fork joint (29) of the structural member. For locking, use will advantageously be made of the pin (17) and its locking cotter pin (30), which furthermore prevents it from going astray.

Provision will also be made on the support arm for an attached lug (31) in order to keep the strut in the locked position on the said bearing arm.

Likewise, the pin bore (32) of the strut will be slipped over a stud rigidly attached to the structural member.

Finally, it will also be possible to provide a safety locking means (33) by the interaction of a gusset-plate, rigidly attached to the foot of the prop, with a fork joint rigidly attached to the structural member, with locking by means of a removable cotter pin.

The props (12, 14) may comprise an individual locking means replacing their assembly in pairs with the aid of the rod (10) so as to permit the removal there-from, for example by rotation by half a turn.

An alternative embodiment has been shown in FIGS. 5*a*, 5*b*, 5*c* and 6, in which the hinge (20) is replaced by a pin (33) rigidly attached to a structural member (34) which can also be folded away into a sheath (35). The overhang of the previous structure is thus limited.

In a preferred manner, each structure which can be transversely folded away will comprise a stop (36) which interacts with a limiter (37).

I claim:

1. An apparatus for supporting a container including a body and a plurality of laterally disposed, longitudinal structural members attached to the body, comprising:

a sheath attached to and extending between the structural members;

a plurality of support arms slidingly received within the sheath and including means for retaining the support arms within the sheath as the support arms are guided along the sheath to a fully opened-out position, wherein the retaining means includes a rod slidably received by a first of the support arms, wherein a first end of the rod includes a stop for engaging the first of the support arms and a second end of the rod is attached to a second of the support arms; and a plurality of support props associated with the support arms and hingedly associated with the structural members of the container so that in a folded-away position, the support props are folded into the structural members without projecting from beneath the body of the container.

2. The apparatus of claim 1 wherein the second end of the rod further includes a lockwasher attached to the second support arm and one of the support props received by the second support arm.

3. The apparatus of claim 2 wherein the lockwasher is welded to face portions of the second support arm.

4. The apparatus of claim 2 wherein the first end of the rod further includes a washer which can slide relative to the first support arm and another of the support props received by the first support arm.

5. The apparatus of claim 4 wherein the first support arm has an inner end, and wherein the retaining means is adjacent to the inner end of the first support arm when the support arms are in the fully opened-out position.

6. The apparatus of claim 5 wherein the first support arm has an outer end opposite to the inner end, and further includes an end stopper welded to the outer end of the first support arm.

7. The apparatus of claim 6 wherein the retaining means is adjacent to the end stopper associated with the outer end of the first support arm when the support arms are in the folded-away position.

8. The apparatus of claim 1 wherein the retaining means further includes a stop and a cooperating limiter for engaging the stop, associated with and extending between the sheath and the support arms.

9. The apparatus of claim 1 wherein the container is a metal container.

10. An apparatus for supporting a container including a body and a plurality of laterally disposed, longitudinal structural members attached to the body, comprising:

a sheath attached to and extending between the structural members;

a plurality of support arms slidingly received within the sheath and including means for retaining the support arms within the sheath as the support arms are guided along the sheath to a fully opened-out position; and a plurality of support props associated with the support arms and hingedly associated with the structural members of the container so that in a folded-away position, the support props are folded into the structural members without projecting from beneath the body of the container;

wherein each of the plurality of support props includes a bearing arm extending from the support arm, and a strut having a first end pivotally connected to the structural member and a second end for pivotable connection to the bearing arm.

11. The apparatus of claim 10 wherein the bearing arm includes a fork joint, and wherein the second end of the strut is connectable to the bearing arm by a removable pin for engaging the fork joint, so that the strut and the bearing arm are movable in a substantially vertical plane.

12. The apparatus of claim 11 wherein the removable pin further includes means for ensuring connection of the strut and the bearing arm.

13. The apparatus of claim 10 wherein the first end of the strut is connected to the structural member by a support plate connected to the structural member and a ball-and-socket fork joint associated with the support plate, for hingedly receiving the first end of the strut.

14. The apparatus of claim 13 wherein the ball-and-socket fork joint further includes a pin for engaging the first end of the strut, and means for retaining the first end of the strut to the pin of the ball-and-socket fork joint.

15. The apparatus of claim 10 wherein the first end of the strut is connected to the structural member by a pin extending from the structural member.

16. The apparatus of claim 15 wherein the structural member includes an opening for receiving the pin so that the strut is foldable into the structural member.

17. The apparatus of claim 10 wherein each of the plurality of support props includes a substantially triangular gusset-plate attached to the bearing arm, and wherein the structural member includes an opening for receiving the gusset-plate so that the gusset-plate is receivable in the opening in the structural member during storage of the support props.

18. The apparatus of claim 10 wherein each of the support props includes means for locking the support props in the folded-away position for storage of the support props.

19. The apparatus of claim 18 wherein the structural member includes a fork joint, and wherein the bearing arm includes a lug for engaging the fork joint of the structural member, for locking the bearing arm in position during storage of the support props.

20. The apparatus of claim 19 wherein the lug of the bearing arm and the fork joint of the structural member are capable of receiving a removable pin for securing the bearing arm to the structural member.

21. The apparatus of claim 18 wherein the bearing arm includes a lug for engaging the strut during storage of the support props, and for retaining the strut in a folded-away position.

22. The apparatus of claim 21 wherein the second end of the strut engages a pin extending from the structural member when in the folded-away position.

23. The apparatus of claim 18 wherein the bearing arm includes a sole-plate attached to foot portions of the bearing arm, and the structural member includes a fork joint for receiving the sole-plate of the bearing arm during storage of the support props.

* * * * *